US005400715A

United States Patent [19]

Roach et al.

[11] Patent Number: 5,400,715

[45] Date of Patent: Mar. 28, 1995

[54] TWO PART AMMUNITION ROUND

[75] Inventors: Graham R. Roach, Aylesford; Stephen R. Fuller, Orpington; Charles D. G. Edwards, Ashford; Steven Gilbert, Snodland, all of United Kingdom

[73] Assignee: The Secretary of State for Defence in Her Britannic Majesty's Government of the United Kingdom of Great Britain and Northern Ireland, London, United Kingdom

[21] Appl. No.: 217,803

[22] Filed: Mar. 28, 1994

[30] Foreign Application Priority Data

Apr. 15, 1993 [GB] United Kingdom ..... 9307799

[51] Int. Cl.[6] ..... F42B 5/02

[52] U.S. Cl. ..... 102/443; 102/202; 102/430; 102/431; 102/439

[58] Field of Search ..... 102/202, 204, 275.4, 102/275.6, 275.11, 430–433, 439, 443, 464, 465, 469, 470, 472, 700

[56] References Cited

U.S. PATENT DOCUMENTS

| | | | |
|---|---|---|---|
| 314,127 | 3/1885 | Ripley | 102/443 |
| 1,756,079 | 4/1930 | Anderson | 102/439 |
| 1,920,075 | 7/1933 | Haenichen | 102/443 |
| 3,581,662 | 6/1971 | Grebert | 102/202 |
| 3,696,749 | 10/1972 | Scanlon | 102/432 |
| 4,777,881 | 10/1988 | Candland et al. | 102/430 |
| 5,155,295 | 10/1992 | Campoli | 102/430 |
| 5,171,932 | 12/1992 | McElroy | 102/700 |
| 5,179,250 | 1/1993 | Campoli | 102/443 |
| 5,180,883 | 1/1993 | Jaskolka et al. | 102/443 |
| 5,237,927 | 8/1993 | Gonzalez et al. | 102/431 |
| 5,241,909 | 9/1993 | Eches et al. | 102/443 |
| 5,263,416 | 11/1993 | Amundson et al. | 102/443 |

FOREIGN PATENT DOCUMENTS

| | | | |
|---|---|---|---|
| 95893 | 11/1960 | Netherlands | 102/443 |
| 9870 | of 1907 | United Kingdom | 102/443 |

*Primary Examiner*—Harold J. Tudor
*Attorney, Agent, or Firm*—Nixon & Vanderhye

[57] ABSTRACT

Ammunition round comprising a forward cartridge 1 including a projectile 6 and a propellant charge 8, a rearward cartridge 2 including a propellant charge 8 and a propellant ignition system 3, 10, 14, and a propellant charge igniter 16 located so as to lie positioned between the first and second propellant charges when the round is loaded, wherein the propellant ignition system includes ignition transfer means 14 for transferring ignition from the rear of the rearward cartridge to the propellant charge igniter and the propellant charge igniter 16 includes ignition propagation means, preferably in the form of igniter cord 26, for spreading ignition laterally to facilitate rapid simultaneous ignition of the two charges.

20 Claims, 2 Drawing Sheets

TWO PART AMMUNITION ROUND

BACKGROUND OF THE INVENTION

1. Field of the Invention

The present invention relates to ammunition rounds in which propellant charge is located in two separate cartridges.

2. Discussion of Prior Art

A primary role for the main battle tank is to take and hold ground. To achieve this it has to have the capability of defeating enemy armour. In recent times there have been substantial improvements in the effectiveness of armour arrays, and to counter these improvements and ensure that the main battle tank retains that capability corresponding improvements are required in the performance of solid propellant tank gun/ammunition systems. These improvements have been achieved mainly by a combination of significant increases in propellant charge weight and the use of very long penetrators so as to deliver the increased kinetic energy per unit area necessary to defeat advanced armour arrays. Because of a number of factors, primarily the requirement to ensure that any new system is compatible with modified existing main battle tank designs, constraints are placed on the maximum diameter for the ammunition round and thus, to accommodate the increased propellant, total round lengths must increase.

In order to facilitate handling of such rounds and stowage within a vehicle it is a requirement, in some cases, to split the ammunition round into two parts. All modern systems use cartridge cases which are either fully or partly combustible and these have to survive a certain amount of rough handling and may occasionally get wet or be exposed to moisture. In order to ensure that the propellant and the pyrotechnic elements contained within the two cartridges are sufficiently protected it is necessary to design robust and water resistant cartridge cases.

Generally the ballistician strives to devise systems which will achieve a smooth, uninterrupted ignition of all of the propellant contained in the gun chamber. In a two part system, where the sole means of propellant ignition is contained in the rear of the primary cartridge, the introduction of thick walled combustible caps, which separate the two propellant charges, delays the ignition of the propellant in the secondary cartridge and this can result in the formation of pressure waves which in extreme cases can increase to a magnitude capable of damaging the gun or projectile. The latter case could result in the detonation of an explosive projectile whilst still within the bore. However, the use of a less substantial barrier to mitigate this problem leaves the cartridge more vulnerable to damp and to damage during handling.

SUMMARY OF THE INVENTION

The object of the invention is to provide a robust two part ammunition round in which propellant ignition occurs in a controlled manner so as to reduce the tendency for adverse pressure waves to be set up and to reduce the time taken for ignition to spread throughout the propellant charge.

Thus according to the invention there is provided an ammunition round comprising a primary cartridge including a first propellant charge and a propellant ignition system, a secondary cartridge including a projectile and a second propellant charge, the two cartridges being loadable into a barrel so as to position a rear end of the secondary cartridge adjacent to a front end of the primary cartridge, and a propellent charge igniter located in a cartridge such that when the round is loaded the propellant charge igniter is positioned between the first and second propellant charges, wherein the propellant ignition system includes ignition transfer means for transferring ignition from the rear of the primary cartridge to the propellant charge igniter and the propellant charge igniter includes ignition propagation means for spreading ignition laterally, such that ignition of both the first and the second propellant charge is initiated from the propellant charge igniter.

During loading the two cartridges may remain separate or may be joined together in the gun chamber or in an autoloader to facilitate removal of the cartridges together should it be necessary to download the complete round.

The presence of ignition propagation means ensures very rapid even outward progression of ignition from the central axis. Initiation spreads very much more rapidly than with conventional segmented cloth bag igniters. As a result, all parts of the proreliant charge igniter are initiated substantially simultaneously. This ensures that ignition of proreliant occurs substantially simultaneously transversely across the cartridge and also causes a rapid generation of sufficient pressure to disrupt the combustible caps which lie between the two cartridges, so that ignition of the first and second proreliant charges is effected almost simultaneously. The delay between ignition of the two cartridges which is encountered in other two part systems can be effectively eliminated and the tendency for undesirable pressure waves to be set up when the round is fired thus dramatically reduced.

The propellant charge igniter may be located either in the primary cartridge forward of the first proreliant charge or in the secondary cartridge rearward of the second propellant charge. However, in the latter configuration the ignition transfer means must be provided with ignition coupling means such as flash tube or electrical contacts to transfer ignition from the forward end of the primary charge to the igniter in the secondary charge. A configuration where the propellant charge igniter is located substantially at the front end of the primary cartridge is simpler and therefore less prone to misfiring and is to be preferred.

A suitable ignition propagation means includes at least one combustible or otherwise consumable propagating member extending transversely through ignitable material in the propellant charge igniter. Consumable outward ignition Propagation means have the advantage of leaving little deposit in the barrel after firing. Igniter cord provides a convenient consumable material, which enables particularly rapid outward progression of ignition from the centre.

Alternatively, the ignition propagation means may include a manifold with outwardly extending passages leading from the forward end of the ignition transfer means to ignitable material within the propellant charge igniter. If complete ignition of the proreliant charge igniter is to be effected as rapidly as possible, the manifold preferably houses a booster charge of pyrotechnic material, which is ignited by the ignition transfer means thereby projecting hot gases and particles through the outwardly extending passages to facilitate ignition of the proreliant charge igniter.

The simultaneous transverse ignition of propellant in a cartridge which is achievable by using a proreliant charge igniter having inserted within it ignition propagation means to produce rapid lateral spread of ignition in the manner described above can also be exploited in isolation if, for example, a round with non-rupturable end caps is to be used, by providing igniters at the front end of the primary and rear end of the secondary cartridges respectively, combined with ignition coupling means such as a flash tube or electrical contacts to transfer ignition from the primary cartridge to the igniter in the secondary cartridge.

To facilitate effective ignition of both the first and the second propellant charge the propellant charge igniter preferably includes gun powder or a material having similar combustion properties.

In order to reduce the amount of material left in a gun barrel after such a round has been fired the ignition transfer means preferably comprises combustible or otherwise consumable material. Igniter cord contained in a combustible sleeve comprises a convenient consumable means. Igniter cord has the advantage of allowing rapid transfer of ignition from the rear of the primary cartridge to the propellant charge igniter, reducing the time delay between the firing of the primer/initiator and ignition of the two propellant charges. The combustible sleeve serves to protect the igniter cord from damage, whilst leaving very little deposit in the barrel after the round has been fired.

To protect the contents of each part of the round from contamination during storage and handling each cartridge requires a robust case to contain the propellant material. Residue left in a gun barrel after the round has been fired is reduced if these are constructed predominantly of combustible material. A typical cartridge case comprises a cylindrical outer casing sealed at each end to contain the propellant charge and ignition system. The rear end of the primary cartridge is likely to be a metal stub casing or the like, and the front end of the secondary cartridge is effectively sealed by the projectile and sabot, but the cylindrical outer casing of one or both cartridges and the means to close the front end of the primary and rear end of the secondary cartridges are appropriately of a combustible material.

Consequently the first propellant charge and the propellant ignition system, and the propellant charge igniter if it is located in the primary cartridge, are preferably contained within a casing comprising a hollow cylindrical tube of combustible material closed at the front end of the primary cartridge by a layer of combustible material in the vicinity of the forward edge of the hollow cylindrical tube. The second propellant charge is preferably contained within a similar casing comprising a hollow cylindrical tube of combustible material closed at the rear end of the secondary cartridge by a layer of combustible material in the vicinity of the rearward edge of the hollow cylindrical tube.

To concentrate the energy available for propellant ignition and thus facilitate the disruption of any barriers separating the ignition system from the propellant charge, and in particular from the second proreliant charge, it is preferable to allow a build up of pressure within the propellant charge igniter before ignition of propellant is initiated. To enable this and to protect and contain the pyrotechnic filling the propellant charge igniter is thus preferably substantially enclosed and isolated from first propellant charge by containment means. The containment means are preferably of combustible material. This will in turn reduce the residue left in the barrel after firing. It is also necessary to minimize rearward gas leakage via any aperture in the containment means which may be associated with connection of the ignition transfer means and to this end the propellant charge igniter preferably includes means to restrict passage of ignition products from the propellant charge igniter rearwards along the direction of the ignition transfer means.

As there is a particular requirement to exclude moisture from ammunition rounds the combustible material used to contain the propellant charge or contain the propellant charge igniter is preferably substantially non-porous.

A suitable substantially non-porous material which will burn at an appropriately fast rate and leave little deposit in a gun barrel comprises nitrocellulose, paper and a resin binder. The finished case is preferably externally coated with a waterproof lacquer.

The ammunition round may include interengagement means for connecting the front end of the primary cartridge to the rear end of the secondary cartridge so that in the event of the round not firing withdrawal of the primary cartridge from a gun barrel will automatically withdraw the secondary cartridge with it. Also, a gun system may in practice be equipped with a range of two part rounds for varied purposes, and this arrangement will permit withdrawal and replacement of a round if the need arises to change the nature of the loaded round. The connection of the two cartridges may be effected in the gun chamber or in an autoloader before loading the round into the gun chamber.

In order to ensure that ignition of propellant occurs transversely across the ammunition round substantially simultaneously the propellant charge igniter preferably occupies substantially all of the transverse cross sectional area of the ammunition round.

BRIEF DESCRIPTION OF THE DRAWINGS

The invention will now be described by way of example only with reference to FIGS. 1 to 5 which show.

DETAILED DISCUSSION OF PREFERRED EMBODIMENTS

Figure 1:
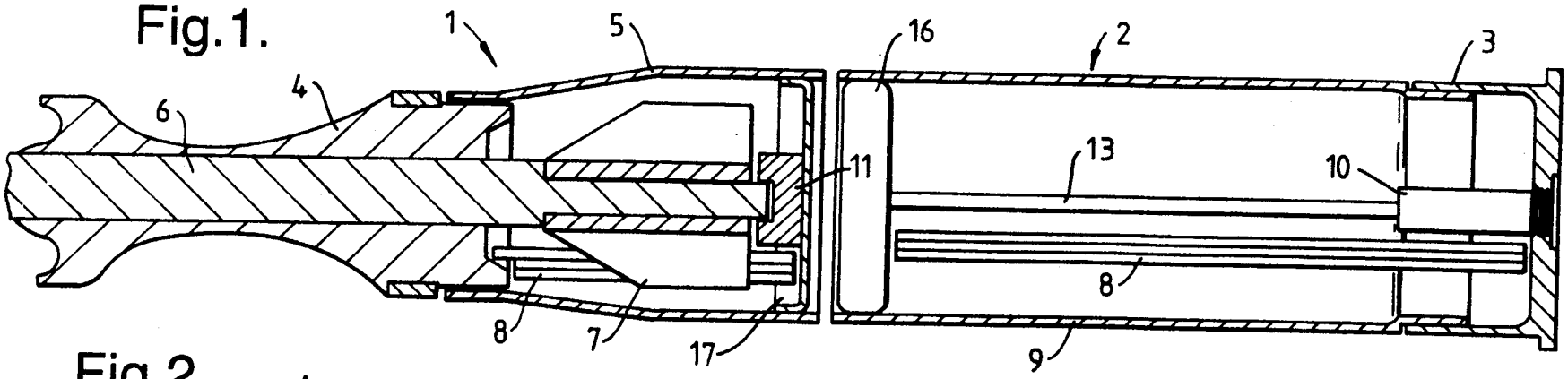
FIG. 1 is a longitudinal cross section of an ammunition round according to the invention with an ignition system shown in outline only.

An ammunition round constructed according to the invention is shown in longitudinal cross section in FIG. 1 (the front part of the projectile has been omitted and the ignition system is shown in outline only). The round comprises a primary cartridge 2 having a combustible outer casing 9 and a secondary cartridge 1 having a combustible outer casing 5. Mounted in the front end of the secondary cartridge 1 is a long rod projectile 6 supported in a sabot 4. A propellant charge of stick propellant 8 (not all shown) is accommodated within the casing 5 and a combustible cap 17 is stuck to and closes the rear end of the secondary section. A fin unit 7 is screwed into the rear end of the projectile 6 which is held in place by a projectile support member 11 glued to the combustible cap 17. The primary cartridge 2 also contains stick propellant 8 and has at its rear end a stub casing 3 which is fixed to the rear end of the casing 9. The primary cartridge 2 accommodates a propellant ignition system comprising an electric igniter 10 and ignition transfer means 13 consisting of igniter cord 12 accommodated within a combustible tube 14 (see FIG. 2) and connected to a propellant charge igniter 16 which will be described in greater detail below.

Figure 2:
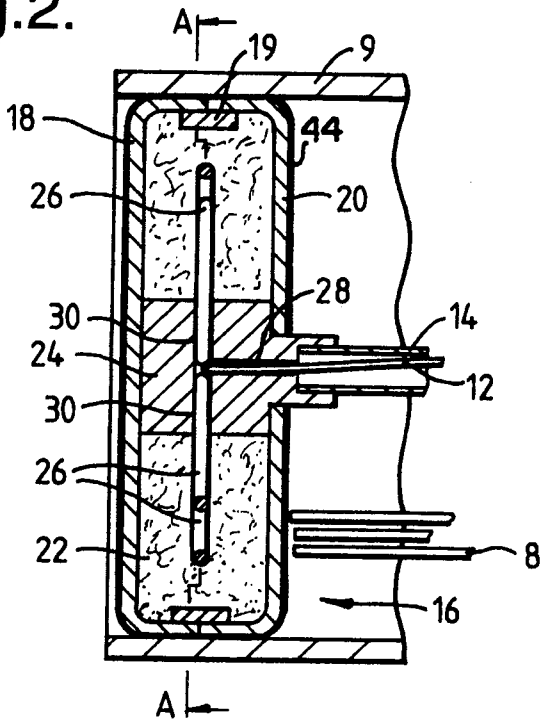
FIG. 2 is a longitudinal cross section of the foremost part of the primary cartridge of the ammunition round shown in FIG. 1.

The propellant charge igniter 16 and the foremost part of the primary cartridge 2 are shown in longitudinal cross section in FIG. 2. Two combustible caps 18 and 20 are connected together by being glued to an annular strip 19 and to a distributor block 24. Components 18, 19 and 20 are made from a Kraft paper and nitrocellulose pulp containing 14% by weight of a resin binder and coated by a waterproof substance 44. The ratio of nitrocellulose to Kraft paper is approximately 2:1 by weight. The thickness of the caps is 3.0 mm. The space between the two caps 18 and 20 is occupied by gun powder 22. For a 120 mm round 100 g of G7 gun powder has been found to be sufficient. This foremost part 16 of the ignition system is connected to the inner surface of the casing 9. Part of the rear surface of the distributor block 24 projects through the cap 20 and is adhered to the combustible tube 14. The igniter cord 12 which is contained within the tube passes into an axial passage 28 in the distributor block 24 where it terminates. Four radial passages 30 in the block radiate outwards from the axial passage 28 and allow ends of two pieces of igniter cord 26 to come into contact with the igniter cord 12 accommodated within the axial passage. The combustible tube runs the length of the primary cartridge 2 of the ammunition round and terminates at its rear end at the stub casing 3 at which point the igniter cord 12 is connected to an electric igniter 10.

The casings 5 and 9, the tube 14 and the cap 17 are all made from the same resin bound Kraft paper and nitrocellulose mixture as the caps 18 and 20.

Figure 3:
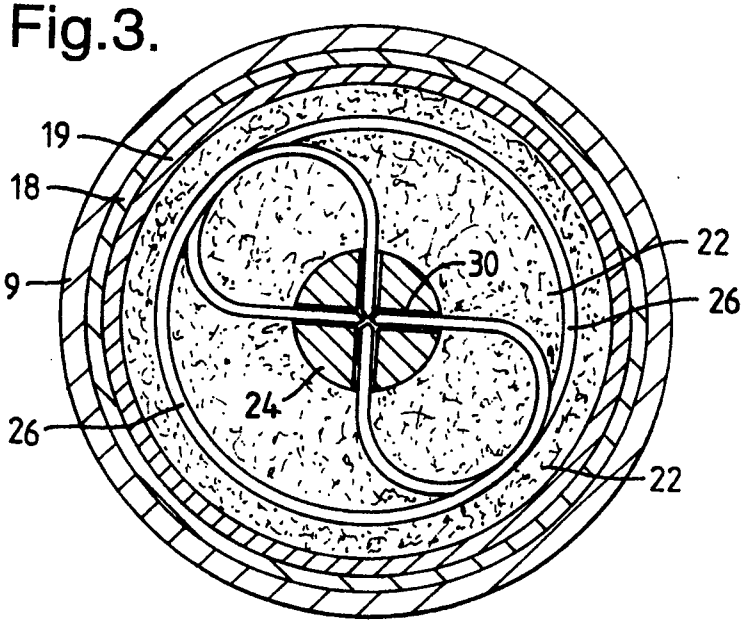
FIG. 3 is a cross section on the line AA of the propellant charge igniter shown in FIG. 2.

When the ammunition round shown in FIGS. 1, 2 and 3 is to be fired the cartridges are loaded through the breach of a gun barrel so that the secondary cartridge 1 lies forward of (that is, nearer to the muzzle than) the primary cartridge 2. The secondary cartridge 1 may be rammed into the gun barrel followed by the primary cartridge 2. Alternatively, the cartridges may be loaded together, the primary cartridge 2 pushing against the secondary cartridge 1. When an electric current is passed through the electric igniter 10 the igniter cord 12 is ignited and rapidly transfers ignition to the propellant charge igniter 16. The combustible tube 14 prevents the burning igniter cord from igniting stick propellant 8 located in the primary cartridge. When ignition reaches the section of igniter cord 12 located within the axial passage 28 of the distributor block 24 ends of the igniter cords 26 are ignited. The igniter cords 26 rapidly spread the ignition outwards through the gunpowder 22 which all starts to burn in a very short space of time. The axial passage 28 in the distributor block 24 is dimensioned to be just large enough to allow passage of the igniter cord 12 so as to restrict passage of ignition products from the propellant charge igniter back into the combustible tube 14 and ensure that energy is concentrated in the propellant charge igniter.

Due to the fact that the gunpowder is contained between the caps 18 and 20 pressure builds up before ignition of any of the propellant is initiated. By allowing the temperature and pressure between the caps to build up then suddenly releasing it as the caps 18 and 20 burst, a rapid transfer of ignition to the stick propellant 8 in the primary cartridge 2 occurs. This sudden release of pressurized hot gases also bursts through and ignites the cap 17 in the secondary cartridge 1 and ignites the stick propellant 8 in the secondary cartridge. Ignition of the propellant in both the primary and the secondary cartridges of the Pound occurs substantially simultaneously. Ignition then spreads outwards uniformly through the propellant and the resulting gas pressure launches the projectile 6 and the sabot 4 from the barrel. All of the other components of the round apart from the stub casing 3 and the distributor block 24 are of combustible material and are consumed. The distributor block 24 is ejected from the barrel by the rapidly expanding hot gases generated by the burnt propellant. The stub casing 3 is then removed from the barrel and a further round can be loaded for firing.

Figure 4:
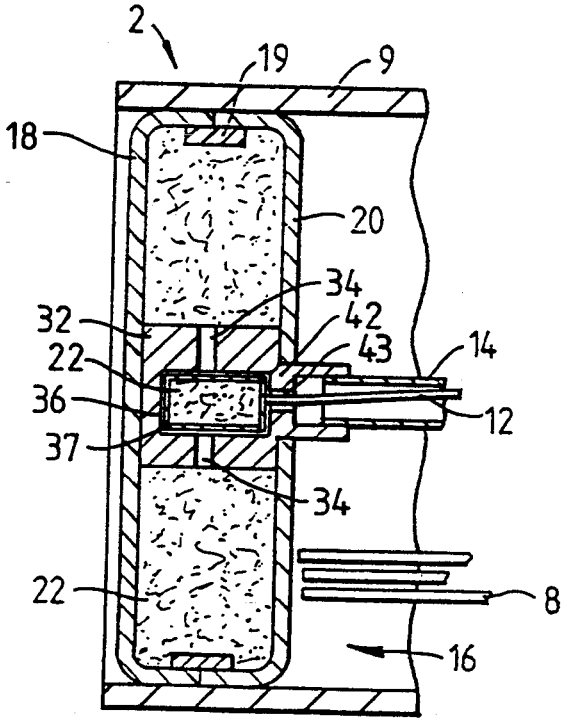
FIG. 4 is a longitudinal cross section of the foremost part of an alternative ignition system.

An alternative embodiment to that shown in FIGS. 1, 2 and 3 is shown in FIG. 4. Only the propellant charge igniter 16 and the foremost part of the primary cartridge 2 are shown as the remainder of the round is identical to that shown in FIG. 1 and like numerals are used to designate similar parts. A centrally disposed manifold 32 is located between two caps 18 and 20 which are glued together by means of an annular strip 19. This assembly is glued to the inner surface of the casing 9. The manifold has a central chamber 36 which houses a booster charge comprising a thin combustible container 37 accommodating a small amount of gunpowder 22. The forward end of a length of igniter cord 12 is adhered to the rear end of the container 37 so as to facilitate transfer of ignition to the gunpowder in the container 37. Radiating from the chamber 36 are four outwardly extending passages 34 which lead to a space between the caps 18 and 20 occupied by gunpowder 22.

After ignition has been transferred to the forward end of the igniter cord 12 the combustible container 37 is burnt away allowing the gunpowder in the container to be ignited. Hot gases and particles are then projected through the passages 34 in order to ignite the gunpowder 22 between the caps. To the rear of the booster charge the manifold 32 has a section of reduced internal diameter 42 which partially closes the chamber 36 so as to define a passage 43. This restricts the passage of the hot gases and particles back into the combustible tube 14 and ensure that the majority of the gases and particles are projected through the passages 34. Ignition spreads rapidly laterally through the gunpowder 22 and the passage 43 to the rear of the manifold 32 now serves to restrict passage of ignition products from the propellant charge igniter back into the combustible tube 14 and ensure that energy is concentrated in the propellant charge igniter. Thereafter ignition of the propellant in both parts of the round proceeds as described above.

Figure 5:
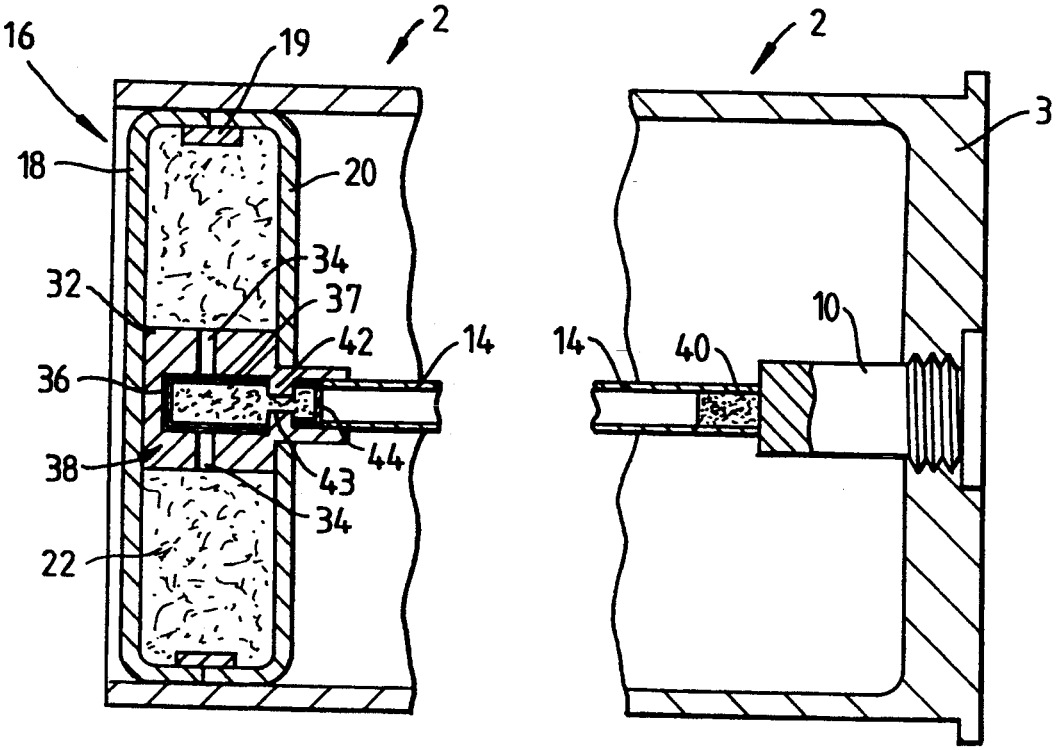
FIG. 5 is a longitudinal cross section of the foremost and rearmost parts of a further alternative ignition system.

A further alternative embodiment to that shown in FIGS. 1, 2, 3 and 4 is shown in FIG. 5. The propellant charge igniter 16 and the foremost part 16 of the primary cartridge 2 are shown as is the rearmost part in the region of the stub casing 3. Where parts are similar to those in previous embodiments they are designated by like numerals.

A centrally disposed manifold 32 identical to the manifold in the embodiment illustrated by FIG. 4 is located between two caps 18 and 20 which are glued together by means of an annular strip 19 so as to define a space containing gunpowder 22. The central chamber 36 of the manifold 32 houses a booster charge 38 comprising a thin combustible container 37 accommodating a small amount of gunpowder 22.

In this embodiment the ignition transfer means is a flashtube, constructed from a combustible tube 14 which runs the length of the primary cartridge 2 of the ammunition round and contains at its rear end a flash charge 40 connected to an electric igniter 10. Towards the rear of the booster charge 38 the manifold 32 has a section of reduced internal diameter 42 which partially closes the chamber 36 so as to define a passage 43 through which inhibits the passage back into the combustible tube 14 of hot gases and particles produced by ignition of the gunpowder located forwards of this section. In order to facilitate ignition of the booster charge 38 via a flash tube mechanism, the charge extends rearwards of the section of reduced internal diameter 42 and the rearmost part of the container 37 is a readily rupturable paper disc 44.

On firing of the round the electric igniter 10 ignites the flash charge 40. Flame and burning fragments are transmitted along the combustible tube 14 to the rear of the booster charge 38, the paper disc 44 is ruptured and subsequently burnt away with the rest of the combustible container 37 and the gunpowder within the rear of the booster charge 38 is ignited. Ignition proceeds rapidly through the passage 43 to the gunpowder contained in the part of the booster charge 38 located forwards of the section of reduced internal diameter 42. Hot gases and particles are then projected through the passages 34 in the manifold 32 and ignition proceeds as described above.

In all of the embodiments described above a fast efficient transfer of ignition can take place between the primary and secondary cartridges of the ammunition round and due to the fact that propellant ignition is initiated in both cartridges almost simultaneously from the front end of the primary cartridge the tendency for adverse pressure waves to be built up as the propellant burns can be reduced.

Apart from the projectile 6 and sabot 4 which are projected from a gun barrel on firing and the stub casing 3 and the distributor block 24 or manifold 32 as appropriate to the embodiment all of the other components of the round are made from combustible material. These components thus burn when the round is fired leaving only debris which is swept out of the barrel, along with the distributor block 24 or manifold 32, by the passage of the rapidly expanding gases produced by the burning of the propellant.

We claim:

1. Ammunition round comprising:

a primary cartridge including a first propellant charge and a propellant ignition system;

a secondary cartridge including a projectile and a second propellant charge, the two cartridges being loadable into a barrel so as to position a rear end of the secondary cartridge adjacent to a front end of the primary cartridge; and a propellant charge igniter located in one of said cartridges and positioned between the first and second propellant charges, wherein the propellant ignition system includes ignition transfer means for transferring ignition from the rear of the primary cartridge to the propellant charge igniter and the propellant charge igniter includes ignition propagation means for spreading ignition laterally, said propellant charge ignitor comprises a sole means for directly igniting both the first propellant charge and the second propellant charge.

2. Ammunition round as claimed in claim 1 wherein the propellant charge igniter is located substantially at the front end of the primary cartridge.

3. Ammunition round as claimed in claim 1 wherein the ignition propagation means includes at least one consumable propagating member extending transversely through the propellant charge igniter.

4. Ammunition round as claimed in claim 3 wherein the at least one propagating member is igniter cord.

5. Ammunition round as claimed in claim 1 wherein the ignition propagation means includes a manifold with outwardly extending passages.

6. Ammunition round as claimed in claim 5 wherein the manifold houses a booster charge of pyrotechnic material.

7. Ammunition round as claimed in claim 1 wherein the propellant charge igniter includes gun powder.

8. Ammunition round as claimed in claim 1 wherein the ignition transfer means comprises consumable material.

9. Ammunition round as claimed in claim 8 wherein the consumable material comprises igniter cord contained in a combustible sleeve.

10. Ammunition round as claimed in claim 8 wherein the consumable material comprises a combustible flashtube.

11. Ammunition round as claimed in claim 1 wherein the first propellant charge and propellant ignition system are contained within a casing comprising a hollow cylindrical tube of combustible material closed at the front end of the primary cartridge by a layer of combustible material.

12. Ammunition round as claimed in claim 11 wherein the propellant charge igniter is located substantially at the front end of the primary cartridge and is contained within the casing.

13. Ammunition round as claimed in claim 12 wherein the propellant charge igniter is substantially enclosed and isolated from the first propellant charge by containment means.

14. Ammunition round as claimed in claim 13 wherein the propellant charge igniter further comprises means to restrict passage of ignition products from the propellant charge igniter rearwards along the direction of the ignition transfer means.

15. Ammunition round as claimed in claim 13 wherein the containment means is of combustible material.

16. Ammunition round as claimed in claim 1 wherein the second propellant charge is contained within a casing comprising a hollow cylindrical tube of combustible material closed at the rear end of the secondary cartridge by a layer of combustible material.

17. Ammunition round as claimed in claim 15 wherein the combustible material is substantially nonporous.

18. Ammunition round as claimed in claim 17 wherein the combustible material comprises paper, nitrocellulose and a resin binder.

19. Ammunition round as claimed in claim 18 wherein the combustible material is externally coated with a waterproof substance.

20. Ammunition round as claimed in claim 1 wherein the propellant charge igniter occupies substantially all of the transverse cross sectional area of the ammunition round.

* * * * *